US005559297A

United States Patent [19]

Yoshikawa et al.

[11] Patent Number: 5,559,297

[45] Date of Patent: Sep. 24, 1996

[54] KEY FOR KEYBOARD INSTRUMENT HAVING A PERSPIRATION-ABSORBING SURFACE

[75] Inventors: Yoshimasa Yoshikawa; Keisuke Watanabe, both of Hamamatsu, Japan

[73] Assignee: Yamaha Corporation, Japan

[21] Appl. No.: 278,899

[22] Filed: Jul. 22, 1994

[30] Foreign Application Priority Data

Jul. 28, 1993 [JP] Japan ..... 5-186277

[51] Int. Cl.[6] ..... G10C 3/12

[52] U.S. Cl. ..... 84/433; 84/437; 84/452 R

[58] Field of Search ..... 84/433, 437, 438, 84/452 R

[56] References Cited

U.S. PATENT DOCUMENTS

| | | | |
|---|---|---|---|
| 115,988 | 5/1918 | Collier | 84/437 |
| 3,417,649 | 12/1968 | Wood | 84/433 |
| 4,346,639 | 8/1982 | Vagias | 84/437 |
| 4,486,041 | 7/1989 | Kumano et al. | 84/435 |
| 5,265,515 | 11/1993 | Calabrese et al. | 84/437 |

*Primary Examiner*—Patrick J. Stanzione

*Attorney, Agent, or Firm*—Graham & James LLP

[57] ABSTRACT

A key for keyboard instruments includes a molded key body and a perspiration-absorbing sheet. The molded key body is pivotally secured to a supporting member of the instrument and formed of a synthetic resin. The perspiration-absorbing sheet is provided over the surface of the key body so that the perspiration-absorbing sheet serves as a top, playing surface of the key.

12 Claims, 2 Drawing Sheets

KEY FOR KEYBOARD INSTRUMENT HAVING A PERSPIRATION-ABSORBING SURFACE

BACKGROUND OF THE INVENTION

This invention relates to a key adapted to be pivotally secured to a key supporting member of any keyboard instrument such as a piano, an electric piano or an electric organ.

Wood or synthetic resin has been generally used for forming keys for keyboard instruments. A key made of synthetic resin, however, has a poor moisture-absorbing property and its surface is smooth so that a player often experiences slip of fingertips due to perspiration and feels unpleasant stickiness on the keyboard. While a key made of wood does not pose the above problems, it is very difficult to make wooden keys having uniform dimensions by machining.

SUMMARY OF THE INVENTION

It is, therefore, an object of the present invention to provide a key for keyboard instruments which is free from the disadvantages associated with the conventional keys.

It is a particular object of the present invention to provide a key which can be produced at a low cost, has a high dimensional accuracy, exhibits good perspiration-absorbing property, and gives excellent touch feeling to the player.

In accomplishing the foregoing objects, there is provided in accordance with the present invention a key for keyboard instruments which comprises a molded key body adapted to be pivotally secured to a key supporting member of the keyboard instrument and formed of a synthetic resin, and a perspiration-absorbing sheet provided over the surface of the key body so that the perspiration-absorbing surface is provided over the top surface of the key.

The perspiration-absorbing sheet may be bonded to the key body with an adhesive. Alternatively, the key body is fuse-bonded to the sheet. The perspiration-absorbing sheet may be formed of a material selected from among wood, animal skin, or ceramic material including artificial ivory. Such materials generally have a multiplicity of pores or capillaries and, hence, is able to quickly absorb moisture or sweat from the fingertips so that a player on the keyboard does not encounter slip or sticky feeling during playing. Furthermore, such materials have surface roughness and provide soft feeling on the fingertips suitable for the player.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

Figure 1:
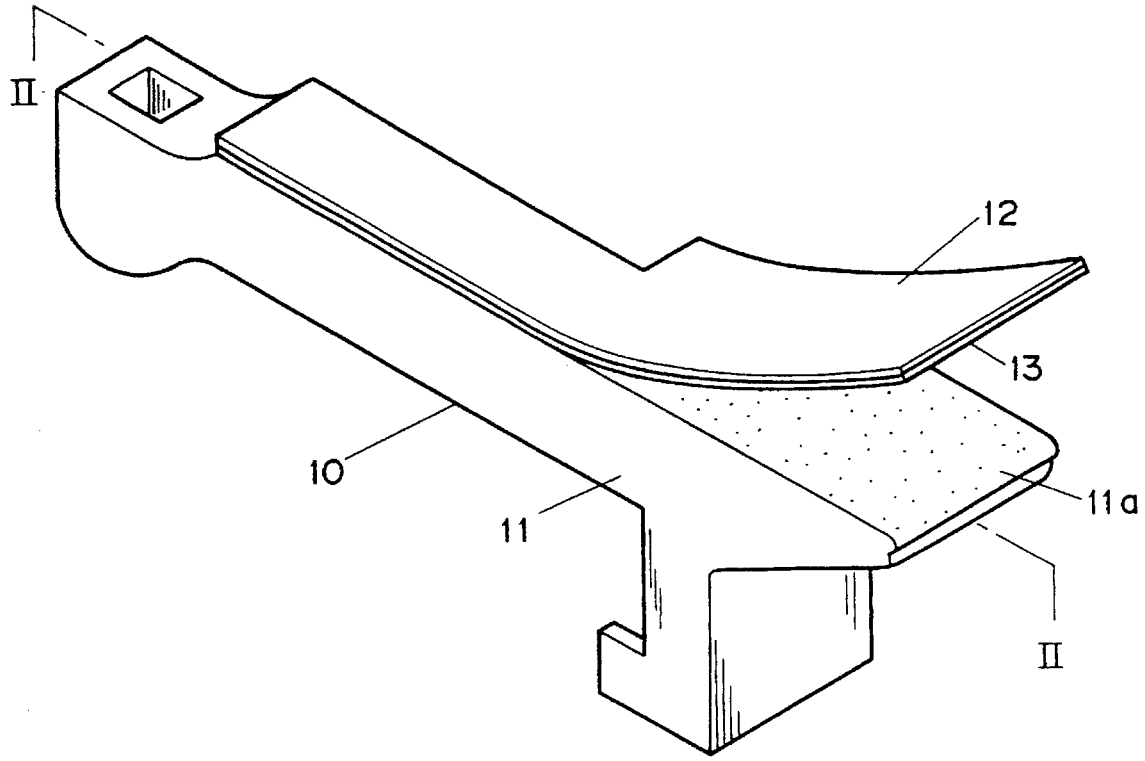
FIG. 1 is a perspective view showing an embodiment of a key according to the present invention in a process of manufacture in which a surface sheet is being bonded to a key body.
Figure 2:
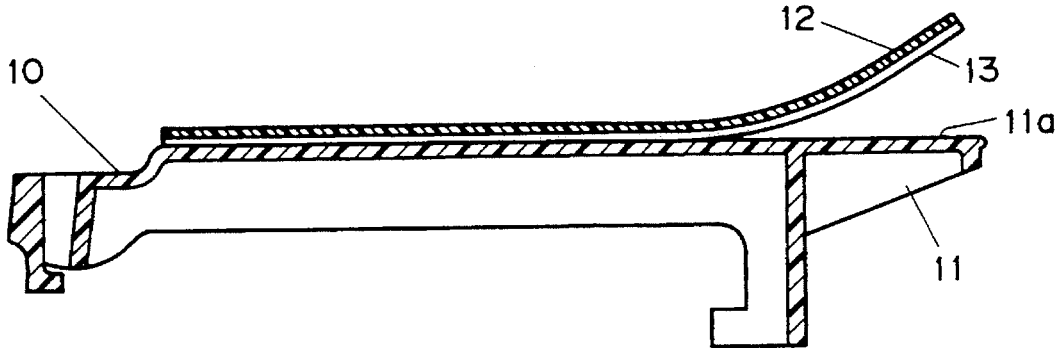
FIG. 2 is a sectional view taken along the line II—II in FIG. 1.

Referring now to FIGS. 1 and 2, designated generally as 10 is a key for a keyboard instrument according to the present invention. The key is composed of a molded key body 11 formed of a synthetic resin such as, acrylonitrile-styrene copolymer (AS resin) or acrylonitrile-butadiene-styrene resin (ABS resin), and a perspiration-absorbing sheet 12 provided over the surface of the key body 11. The shape or structure of the key 10 is the same as that of any conventional key and therefore specific explanation thereof is omitted here. The key 10 is constructed so as to be pivotally mounted on a key supporting mechanism (not shown) of the keyboard instrument in any conventionally known manner.

In the embodiment of FIG. 1, the perspiration-absorbing sheet 12 is bonded to the key body 11 with an adhesive 13. The sheet 12 preferably has a thickness of 0.1–2.0 mm, more preferably 0.5–1.0 mm. The height of the key body 11 is reduced by a value corresponding to the thickness of the sheet 12.

Preferably the portion 11*a* of the key body 11 to which the sheet 12 is bonded has a roughened surface so as to provide an increased bonding area. The roughened surface 11*a* may be formed by molding the key body 11 with a mold provided with a complementary roughened inside surface. Since the adhesive 13 is anchored both in the recessed portions of the roughened surface 11*a* and in the pores or capillaries of the sheet 12, the sheet 12 is firmly bonded to the key body 11 with the adhesive 13. In this case, since the mold for the forming of the key body 11 is not required to be finished like a mirror surface, the production cost as a whole can be significantly reduced.

Figure 3:
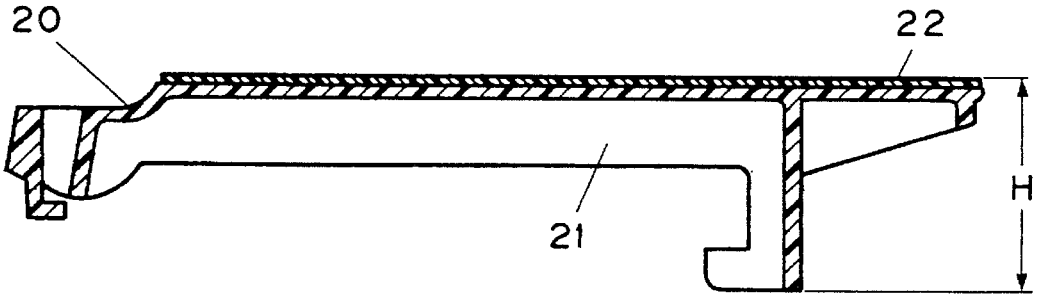
FIG. 3 is a sectional view, similar to FIG. 2, showing another embodiment of the present invention.

Referring to FIG. 3 showing another embodiment according to the present invention, the reference numeral 20 designates a key having a key body 21 fuse-bonded to a perspiration-absorbing sheet 22 without using any adhesive. The key 20 is produced by molding the key body 21 in a mold cavity into which the sheet 22 has been inserted beforehand, as shown in FIG. 4.

Figure 4:
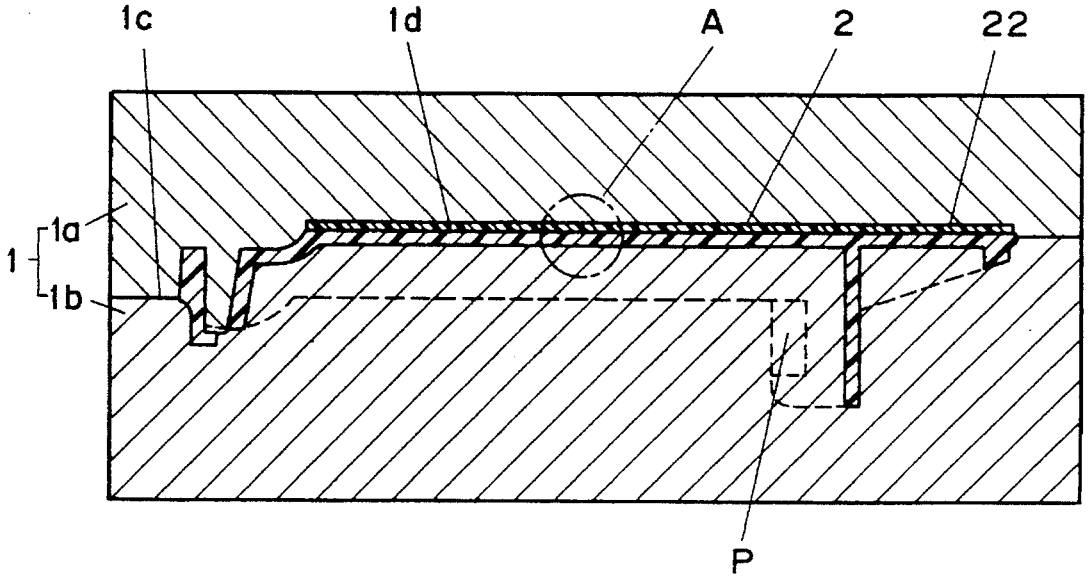
FIG. 4 is a sectional view showing a molding step in the production of the key shown in FIG. 3.

In FIG. 4, designated as 1 is a mold having an upper, stationary mold half 1*a*, a lower, movable mold half 1*b*, and a runner and gate section 1*c* between the mold halves 1*a* and 1*b*. In a closed state, the upper and lower mold halves define a mold cavity 1*d* therebetween. After fitting the sheet 22 to an inside wall of the upper mold half 1*a*, the mold half 1*b* is moved upward to close the mold 1. Then, molten material or melt 2 is injected into the mold cavity 1*d*. After cooling, the mold half 1*b* is moved downward to release the molded key 20 shown in FIG. 3. In FIG. 4, designated as P is a slide core for forming a concave, stopper section of the key body 21.

Figure 5:
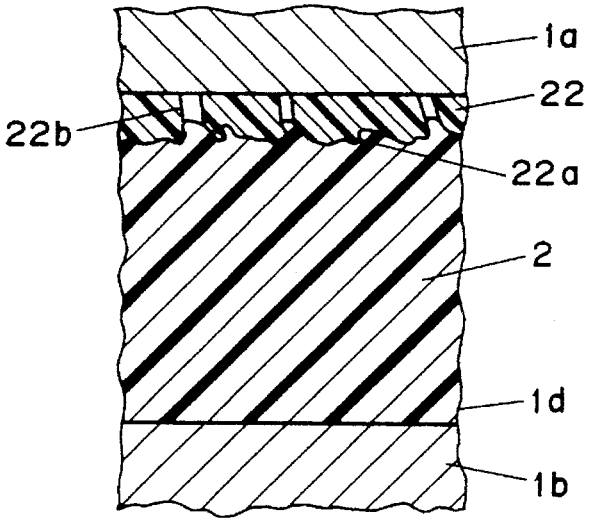
FIG. 5 is an enlarged view of the portion A in FIG. 4.

During the injection molding with the mold 1, the melt 2 injected into the mold cavity 1*d* presses the sheet 22 against the wall of the mold cavity 1*d* so that the sheet 22 has a smooth flat surface corresponding to the smoothness of the cavity wall. Furthermore, as shown in FIG. 5, the melt 2 enters the recessed portions 22*a* and pores or capillaries 22*b* of the sheet 22 to provide tight bonding between the key body 21 and the sheet 22.

Additional advantages are provided from the second embodiment: Even if the thickness of the sheets 22 to be inserted into the mold cavity 1*d* is not uniform, the height H (FIG. 3) of the keys 20 produced is always maintained constant. Furthermore, a bonding step using an adhesive is not required so that the production cost is reduced. Moreover, the second embodiment is free from the disadvantages caused by the thickness of the adhesive layer in the first embodiment. Furthermore, a flat smooth sheet surface is provided irrespective of the thickness of the sheet 22. Thus, the second embodiment permits the use of a very thin sheet 22. Furthermore, since the sheet 22 is subjected to a high temperature and internal strains of the sheet 22 are relieved during the key body molding step, the adhesion between the sheet and the key body 21 is not weakened upon repeated hard depressions on the key 20. The key 20 of the second embodiment may be produced with the existing mold; it is not necessary to prepare a new injection mold with different dimensions of the mold cavity.

The present invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A key for keyboard instruments comprising a key body and a perspiration-absorbing sheet formed of wood provided over a surface of said key body so that said perspiration-absorbing sheet provides a top playing surface of said key.

2. A key as claimed in claim 1, wherein said sheet is bonded to said key body with an adhesive and said surface of said key body is roughened to improve the adhesion thereof to said sheet with said adhesive.

3. A key as claimed in claim 1, wherein said sheet has a fingertip slip resistance suitable for playing.

4. A key as claimed in claim 1, wherein said key body is formed of a synthetic resin.

5. A key for keyboard instruments comprising a key body formed of a synthetic resin and a perspiration-absorbing sheet providing over a surface of said key body so that said perspiration-absorbing sheet provides a top playing surface of said key, wherein said key board is fuse-bonded to said sheet.

6. A key as claimed in claim 5, wherein said key body is formed by inserting said sheet into a mold cavity followed by forming said key body by injection molding.

7. A key for keyboard instruments comprising a key body and a perspiration-absorbing sheet provided over a surface of said key body so that said perspiration-absorbing sheet provides a top playing surface of said key, wherein said key body is fuse-bonded to said sheet.

8. A key as claimed in claim 7, wherein said key body is formed by inserting said sheet into a mold cavity followed by forming said key body by injection molding.

9. A key for keyboard instruments comprising a key body and a perspiration-absorbing sheet formed of animal skin providing over a surface of said key body so that said perspiration-absorbing sheet provides a top playing surface of said key.

10. A key as claimed in claim 9, wherein said sheet is bonded to said key body with and adhesive.

11. A key as claimed in claim 10, wherein said surface of said key body is roughened to improve the adhesion thereof to said sheet with said adhesive.

12. A key as claimed in claim 9, wherein said sheet has a fingertip slip resistance suitable for playing.

* * * * *